United States Patent [19]

Hipp

[11] 4,119,041

[45] Oct. 10, 1978

[54] LOCKING MECHANISM FOR A PAIR OF RAILROAD HOPPER DOORS

[75] Inventor: James D. Hipp, Toledo, Ohio

[73] Assignee: Midland-Ross Corporation, Cleveland, Ohio

[21] Appl. No.: 816,368

[22] Filed: Jul. 18, 1977

[51] Int. Cl.[2] ..... B61D 7/18

[52] U.S. Cl. ..... 105/308 R; 105/253; 292/68

[58] Field of Search ..... 105/308 R, 253; 292/68, 292/108, 114, 210, 218

[56] References Cited

U.S. PATENT DOCUMENTS

| | | | |
|---|---|---|---|
| 3,238,898 | 3/1966 | Floehr | 105/308 R |
| 3,804,026 | 4/1974 | McNally | 292/210 X |

*Primary Examiner*—Robert G. Sheridan

*Attorney, Agent, or Firm*—Harlan E. Hummer

[57] ABSTRACT

A locking mechanism for a pair of hopper doors which are laterally spaced side-by-side transversely of a railroad hopper car. A specially designed locking pawl is provided for retaining the cams in interlocked relation with the hooks of the locking mechanism. The pawl is so designed that a single operator standing by the side of a hopper car, can operate both hopper doors which are mounted together for unitary rotation.

9 Claims, 4 Drawing Figures

LOCKING MECHANISM FOR A PAIR OF RAILROAD HOPPER DOORS

BACKGROUND OF THE INVENTION

U.S. Pat. No. 3,238,898 shows and describes a typical locking mechanism which is in use today for holding individual hopper doors of a railroad hooper car in closed relation. The locking pawls of such mechanisms used on a pair of hopper doors transversely spaced on a hopper car, must be separately operated to disengage the camming mechanisms so that they, in turn, can be rotated out of interlocking engagement with the hooks which are fastened to the hopper door frames adjacent the marginal edges of the hopper doors. Further, the pawls must be operated from opposing sides of the hopper car. This requires an operator on either side of the car or, if a single operator is in attendance, then the operator must first disengage one pawl from one side of the hopper car and then go to the other side of the car to disengage the other pawl. This is not only time consuming and expensive, but endangers the life of a single operator who is forced to walk between a pair of coupled railroad cars to disengage the pawls. The invention is designed to overcome this problem by providing a locking mechanism which can be controlled by a single operator from either side of a railroad hopper car.

Briefly stated, the invention is in a locking mechanism for a pair of hopper doors which are laterally spaced side-by-side transversely of a railroad hopper car. At least one L-shaped cam with a handle, is rotatably mounted on each of the pair of hopper doors. At least one hook is fixedly disposed adjacent each of the cams for interlocking engagement with the cams to hold the hopper doors in closed relation against a hopper door frame which is secured to each of the hoppers of the railroad hopper car. Means are provided for mounting the pair of hopper doors for unitary rotation to and from the hopper door frames and for mounting the cams for unitary rotation, into and out of interlocking relation with the hooks. A locking pawl is carried by each of the hopper doors for interlocking engagement with the distal end of each handle to keep the cams from rotating out of interlocking engagement with the hooks. Means are supplied for mounting the pawls on the hopper doors for unitary rotation, so that a single operator can disengage, (I) the pawls from the handles, and (II) the cams from the hooks of both hopper doors from either side of the railroad car.

DESCRIPTION OF THE DRAWING

The following description of the invention will be better understood by having reference to the annexed drawing, wherein.

DETAILED DESCRIPTION OF THE DRAWING

Figure 1:
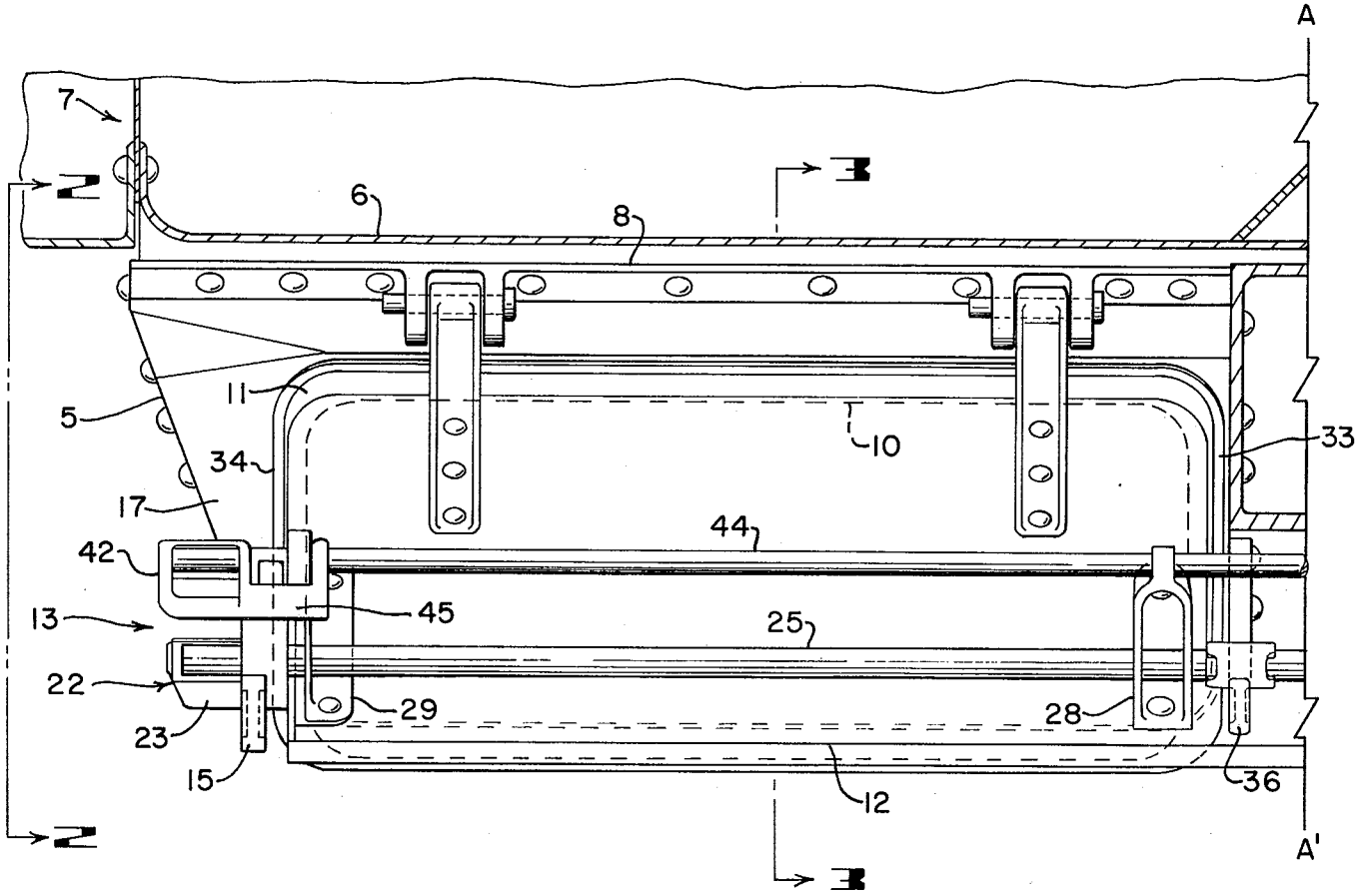
FIG. 1-1A is a front view of a portion of the undercarriage of a railroad hopper car, illustrating a pair of hopper doors and a latching mechanism made in accordance with the invention.
Figure 1A:
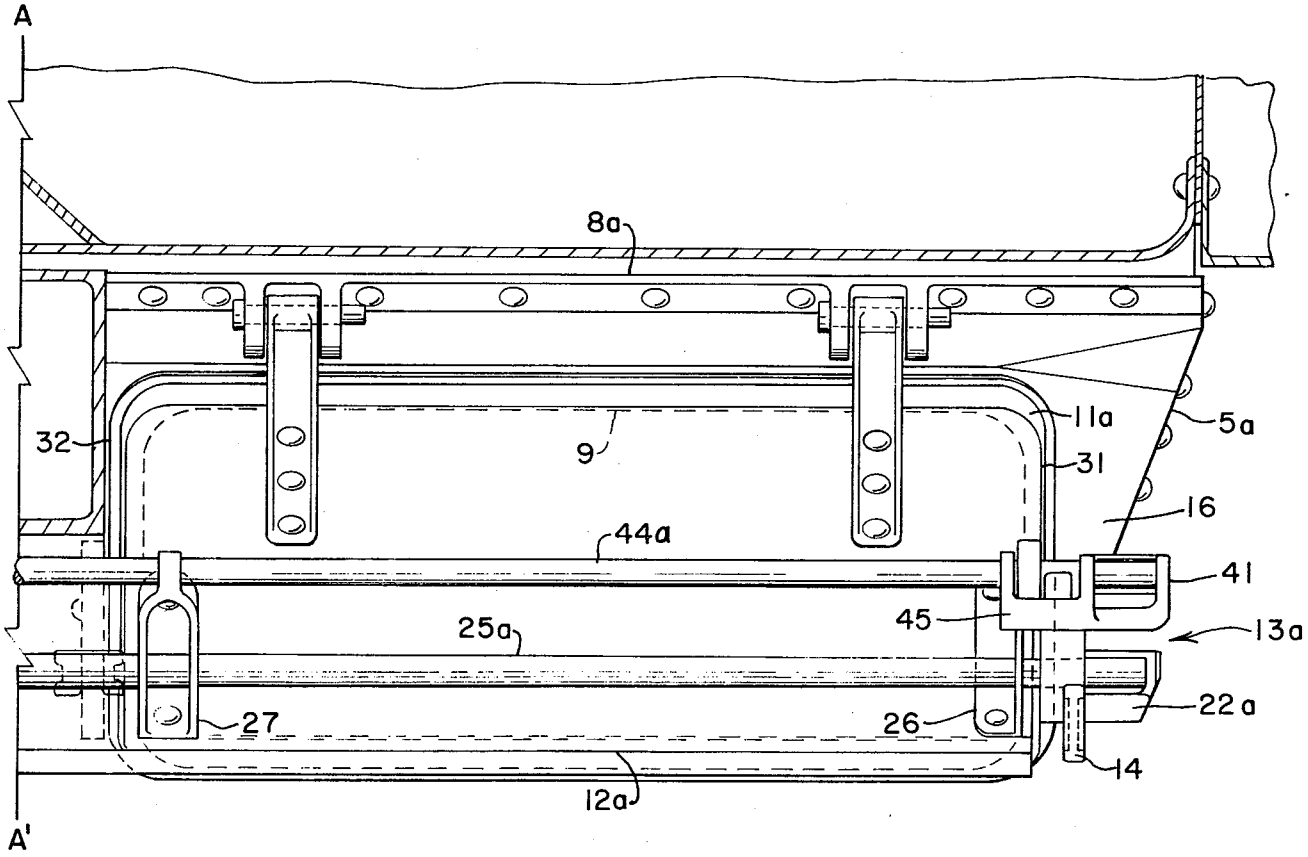
Figure 2:
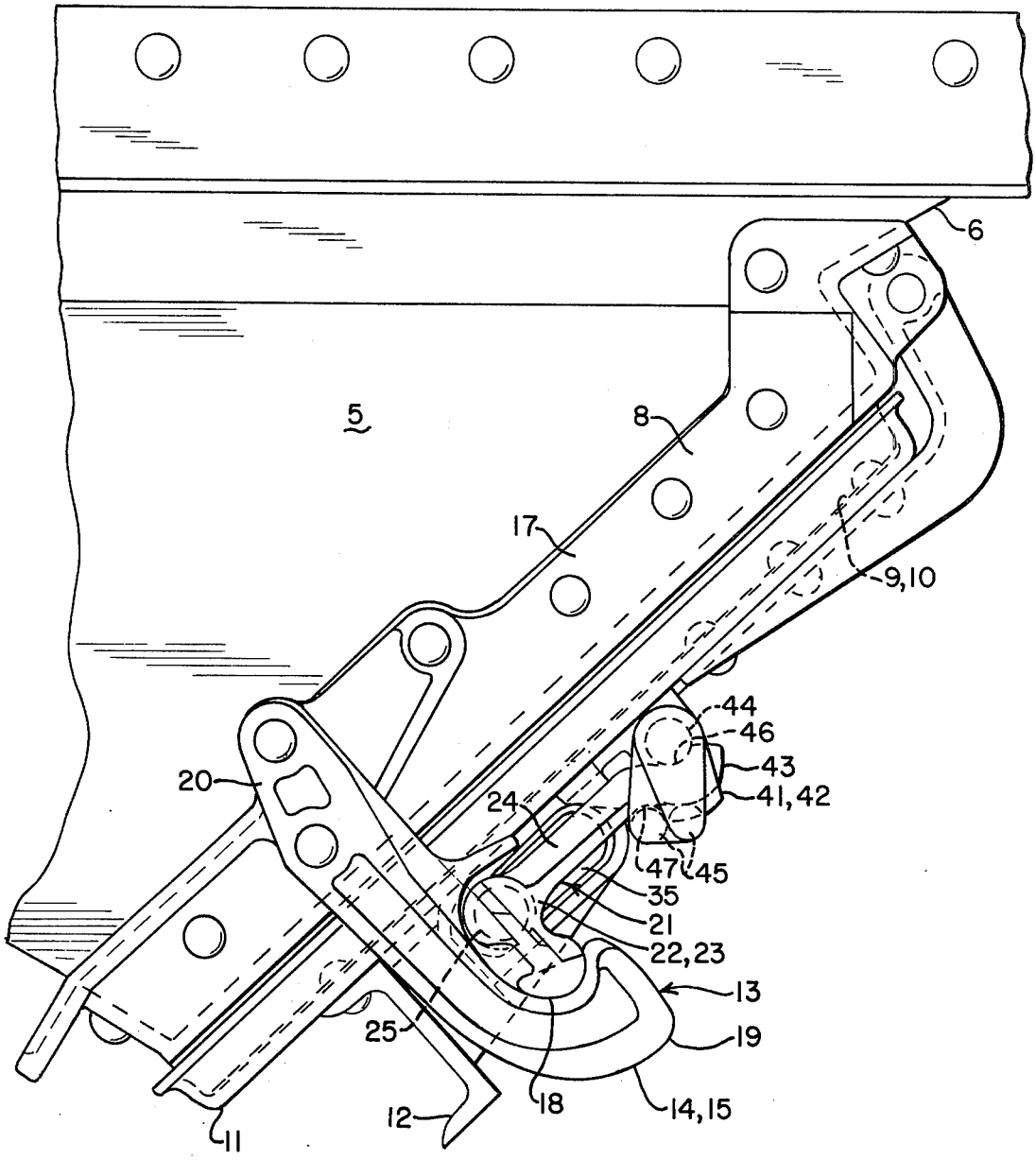
FIG. 2 is a view of the hopper door and latching mechanism from the line 2—2 of FIG. 1.

With reference to FIGS. 1-1A and 2, there is shown a pair of laterally spaced and aligned hoppers 5 which extend from the undercarriage 6 of a railroad hopper car 7. A hopper door frame 8 is secured to each of the hoppers 5 and define openings 9, 10 through which material, carried by the railroad hopper car 7, exits the hoppers 5. A hopper door 11 is conventionally hinged to each of the hopper door frames 8 for rotation, by gravity, from a closed position against the hopper door frames 8 to an open position where the hopper doors 11 are in a generally vertical position when the railroad hopper car 7 is horizontally disposed. A rigid, metal channel 12 is secured laterally across the pair of hopper doors 11 to join the hopper doors 11 so that they will rotate, in unison, when opened and closed.

Locking Mechanism

A locking or latching mechanism 13 is provided for holding the hopper doors 11 firmly closed against the hopper door frames 8. The locking mechanism 13, in this instance, comprises a pair of hooks 14, 15 (FIG. 2) which are bolted in outstanding relation to the laterally, outermost, converging sides 16, 17 of the hopper door frames 8. The hooks 14, 15 are each provided with a recess 18 intermediate their distal and proximal ends 19, 20.

A camming device 21 is carried by the hopper doors 11 for interlocking engagement with the hooks 14, 15. The camming device 21 comprises a pair of generally L-shaped cam 22, 23, each of which includes an outstanding cam arm or handle 24. The cams 22, 23 are designed to be received in the recesses 18 of the hooks 14, 15, in which position the handles 24 generally parallel the hopper doors 11, as best seen in FIG. 2. The L-shaped cams 22, 23 are joined for unitary rotation by a bar 25 which extends laterally across the hopper doors 11. The bar 25 is slidably mounted in brackets 26–29 which are secured to the hopper doors 11, preferably adjacent their side marginal edges 31–34. Actually, the bar 25 is slidable in an elongated slot 35 which is formed in each of the brackets 26–29 in parallel relation with the hopper doors 11. If desired, a third, or even a fourth hook with an interlocking cam, can be provided adjacent the more closely spaced side marginal edges 32, 33 of the hopper doors 11.

Figure 3:
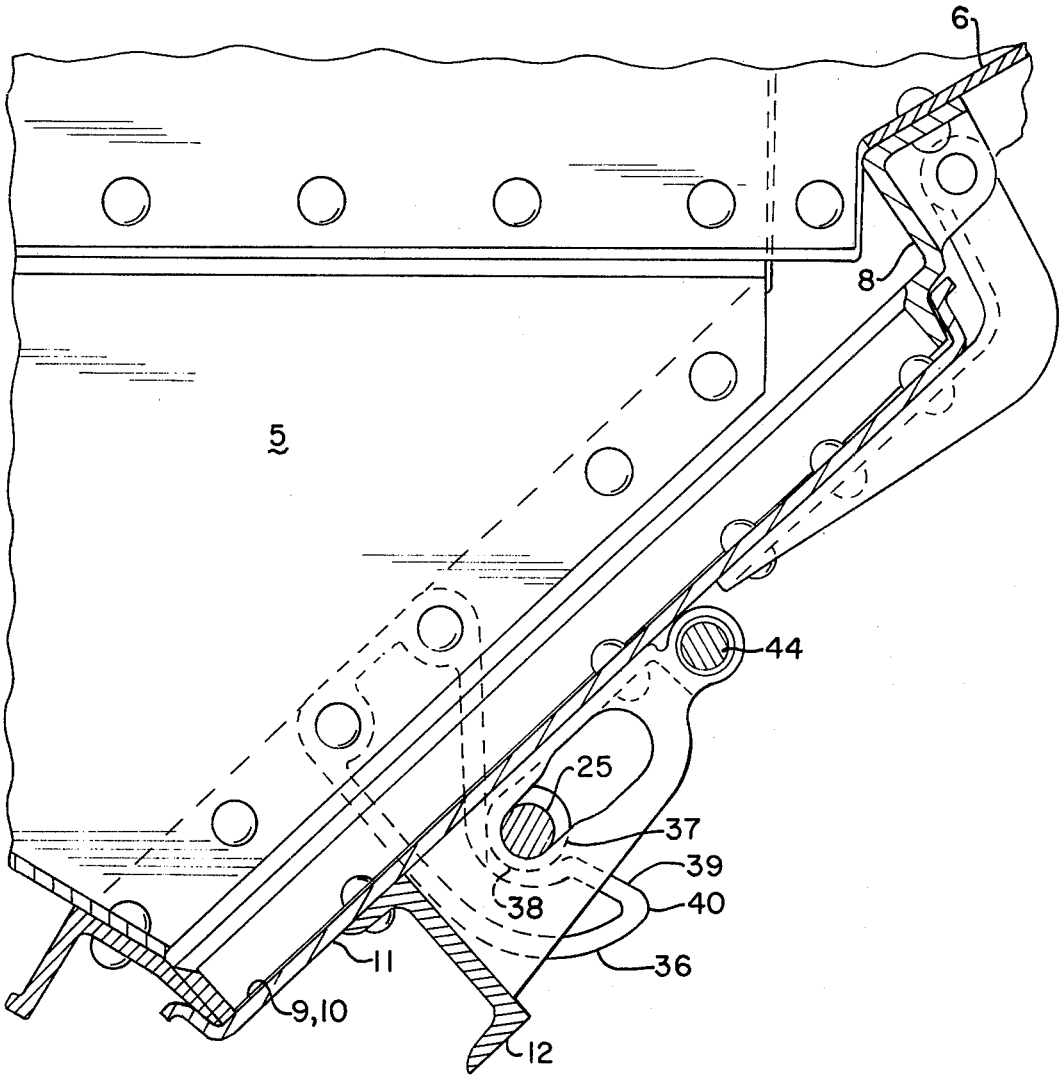
FIG. 3 is a section view from the line 3—3 of FIG. 1.

In this instance, a third hook 36 (FIG. 3) is provided between the hopper doors 11. The third hook 36 has a slightly different configuration, however, since it is designed to receive a cam 37 having a circular cross-section which is slightly enlarged from that of the bar 25 to which the cam 37 is secured. The third hook 36 is provided with a semi-circular recess 38 for accommodating the cam 37 when the L-shaped cams 22, 23 are fully interlocked with the hooks 14, 15. The cam 37 rides along a surface 39 located at the distal end 40 of the third hook 36. The surface 39 is shaped to correspond to the pathway which the cam 37 moves into the semi-circular recess 38, as the cams 22, 23 are rotated into interlocking engagement with the hooks 14, 15.

A specially designed set of locking pawls 41, 42 are provided for interlocking engagement with the distal ends 43 of the handles 24 of the L-shaped cams 22, 23. The locking pawls 41, 42 are joined for unitary rotation by a rod 44 which is journaled for rotation in the brackets 26–29 in parallel relation with the bar 25. The locking pawls 41, 42 each carry a rigid latch 45 which is in predetermined spaced, parallel relation to the rod 44 which joins the locking pawls 41, 42. The rigid latches 45, as best seen in FIG. 2, are designed to interlockingly engage the distal ends 43 of the L-shaped cams 22, 23. In the preferred embodiment, the distal ends 43 of the cams 22, 23 are specially configured or curved, e.g. slightly S-shaped, so that the opposing sides or faces 46, 47 of the distal ends 43 engage the rod 44 and latch 45, respectively, and become rigidly interlocked therebetween when the locking pawls 41, 42 are rotated to their fully locked position, as seen in FIG. 2.

The L-shaped cams 22, 23, and locking pawls 41, 42, as best seen in FIG. 1, are provided with specially configured slots for accommodating conventional steel bars used by an operator to rotate and disengage the locking pawls from the L-shaped cams 22, 23 and the L-shaped cams 22, 23 from the hooks 14, 15.

Thus, there has been provided a highly improved locking mechanism for a pair of hopper doors, whereby a single operator can control opening and closing of the doors at either side of the car without jeopardizing his life, or risking injury by having to move between a pair of coupled cars.

What is claimed is:

1. A locking mechanism for a pair of hopper doors which are laterally spaced side-by-side transversely of a railroad hopper car, comprising:

(a) at least one generally L-shaped cam rotatably mounted on each of the pair of hopper doors;

(b) at least one hook fixedly disposed adjacent each cam for interlocking engagement with the cams to hold the hopper doors in closed relation against a hopper door frame which is secured to a hopper of a railroad hopper car;

(c) means mounting the pair of hopper doors for unitary rotation to and from the hopper door frames;

(d) means mounting the cams for unitary rotation;

(e) a locking pawl carried by each of the hopper doors for interlocking engagement with the cams to keep the cams from rotating out of interlocking engagement with the hooks; and (f) means mounting the pawls on the hopper doors for unitary rotation in a plane normal to the plane of the hopper doors, so that an operator can disengage the pawls from the cams and the cams from the hooks of both hopper doors from one side of the railroad car.

2. The locking mechanism of claim 1, wherein the pawls and the mounting means therefor, include:

(g) a rod traversing the pair of hopper doors;

(h) means mounting the rod on the hopper doors for rotation about its longitudinal axis which is parallel to the plane of the hopper doors; and (i) a rigid latch disposed in fixed, parallel relation to the rod for engaging the cams, the latch being mounted for unitary rotation with the rod.

3. The locking mechanism of claim 2, wherein the L-shaped cams each include a handle having a distal end which is curved so that opposing spaced surfaces of said distal ends engage adjacent surfaces of the rod and latch when the pawls are fully interlocked with the cams.

4. The locking mechanism of claim 3, wherein the distal end of each of the handles is slightly S-shaped.

5. The locking mechanism of claim 3, wherein a hook is disposed adjacent each of the marginal edges of the pair of hopper doors in furthest, lateral spaced relation.

6. The locking mechanism of claim 5, which includes a third hook positioned adjacent a marginal edge of one of the pair of hopper doors intermediate the furthest, laterally spaced marginal edges.

7. The locking mechanism of claim 4, wherein the cam mounting means includes a bar which transverses the pair of hopper doors, and the locking mechanism includes a cam with a circular cross-section carried by the bar for interlocking engagement with the third hook.

8. The locking mechanism of claim 7, wherein the third hook includes (I) a recess for receiving the circular sectioned cam, and (II) a surface of the hook on which the circular sectioned cam rides between the distal end and recess of the hook, the surface being contoured to correspond to the pathway which the circular sectional cam follows as the other cams are rotated into interlocking engagement with the other hooks.

9. The locking mechanism of claim 8, which includes a pair of brackets disposed in parallel relation on each of the pair of hopper doors, the brackets being laterally aligned and each including an elongated slot parallel to the plane of the hopper doors and designed to slidably receive the bar transversing the hopper doors.

* * * * *